US012320050B2

(12) United States Patent
Wenzel

(10) Patent No.: US 12,320,050 B2
(45) Date of Patent: Jun. 3, 2025

(54) METHOD AND APPARATUS FOR AUTOMATED ORNAMENTAL DECORATIVE STITCHING

(71) Applicant: INTEVA PRODUCTS, LLC, Troy, MI (US)

(72) Inventor: Edward J. Wenzel, Troy, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 0 days.

(21) Appl. No.: 18/217,703

(22) Filed: Jul. 3, 2023

(65) Prior Publication Data

US 2024/0003067 A1 Jan. 4, 2024

Related U.S. Application Data

(60) Provisional application No. 63/357,644, filed on Jul. 1, 2022.

(51) Int. Cl.
*D05B 29/02* (2006.01)
*D05B 3/02* (2006.01)
(Continued)

(52) U.S. Cl.
CPC ..... *D05B 29/02* (2013.01); *D05B 3/025* (2013.01); *D05B 57/02* (2013.01); *D05B 61/00* (2013.01); *D05B 69/02* (2013.01)

(58) Field of Classification Search
CPC ..... D05B 3/025; D05B 57/02; D05B 29/02; D05B 61/00; D05B 69/02
See application file for complete search history.

(56) References Cited

U.S. PATENT DOCUMENTS 4,574,718 A 3/1986 Scholl et al.
4,787,326 A 11/1988 Scholl et al.
(Continued)

FOREIGN PATENT DOCUMENTS

JP 2001162068 A 6/2001
WO 2016065141 A1 4/2016

OTHER PUBLICATIONS

International Search Report dated Oct. 20, 2023; International Application No. PCT/US2023/026835; 4 pages.
(Continued)

*Primary Examiner* — Danny Worrell
(74) *Attorney, Agent, or Firm* — CANTOR COLBURN LLP

(57) ABSTRACT

Disclosed is an ornamental chain stitching head, including: an upper head assembly, the upper head assembly controls movement of a needle bar and a walking foot mechanism; a walking foot eccentric configured to allow adjustment of a foot lift while a stitch length eccentric is configured to allow for adjustment of both a walking foot and a needle bar advancement via regulation of a rock frame the determines a length of a stitch created by the ornamental chain stitching head; a lower head assembly; and a needle bar cam assembly that drives rotation of the needle bar during each stitch cycle of the ornamental chain stitching head to achieve desired stitch patterns, the needle bar cam assembly is driven directly by an upper shaft through a pair of gears that reduce the needle bar cam assembly speed according to a size ratio of the pair of gears.

20 Claims, 18 Drawing Sheets

(51) Int. Cl.

| | |
|---|---|
| ***D05B 57/02*** | (2006.01) |
| ***D05B 61/00*** | (2006.01) |
| ***D05B 69/02*** | (2006.01) |

(56) References Cited

U.S. PATENT DOCUMENTS

| | | | | |
|---|---|---|---|---|
| 5,799,599 | A * | 9/1998 | Tsukioka | D05B 49/00 112/65 |
| 9,809,176 | B2 * | 11/2017 | Wenzel | D05B 1/06 |
| 11,578,440 | B2 * | 2/2023 | Wendel | D05B 3/00 |
| 2016/0096490 | A1 * | 4/2016 | Wenzel | D05B 1/08 112/202 |
| 2020/0157719 | A1 | 5/2020 | Wendel et al. | |
| 2022/0314902 | A1 * | 10/2022 | Wenzel | D05B 15/00 |

OTHER PUBLICATIONS

Written Opinion dated Oct. 20, 2023; International Application No. PCT/US2023/026835; 4 pages.

International Preliminary Report on Patentability dated Dec. 18, 2024; International Application No. PCT/US2023/026835; 5 pages.

Italian Office Action corresponding to IT Application No. 112024000213606; Issue Date, Apr. 8, 2025, 2 pages (Non-English).

Italian Office Action corresponding to IT Application No. 112024000213606; Issue Date, Apr. 8, 2025, 2 pages (Machine translation).

* cited by examiner

"Plated" "Fractal"

Lower Head Assembly

Lower Head Assembly - Spread Drive

Stitch Formation Sequence

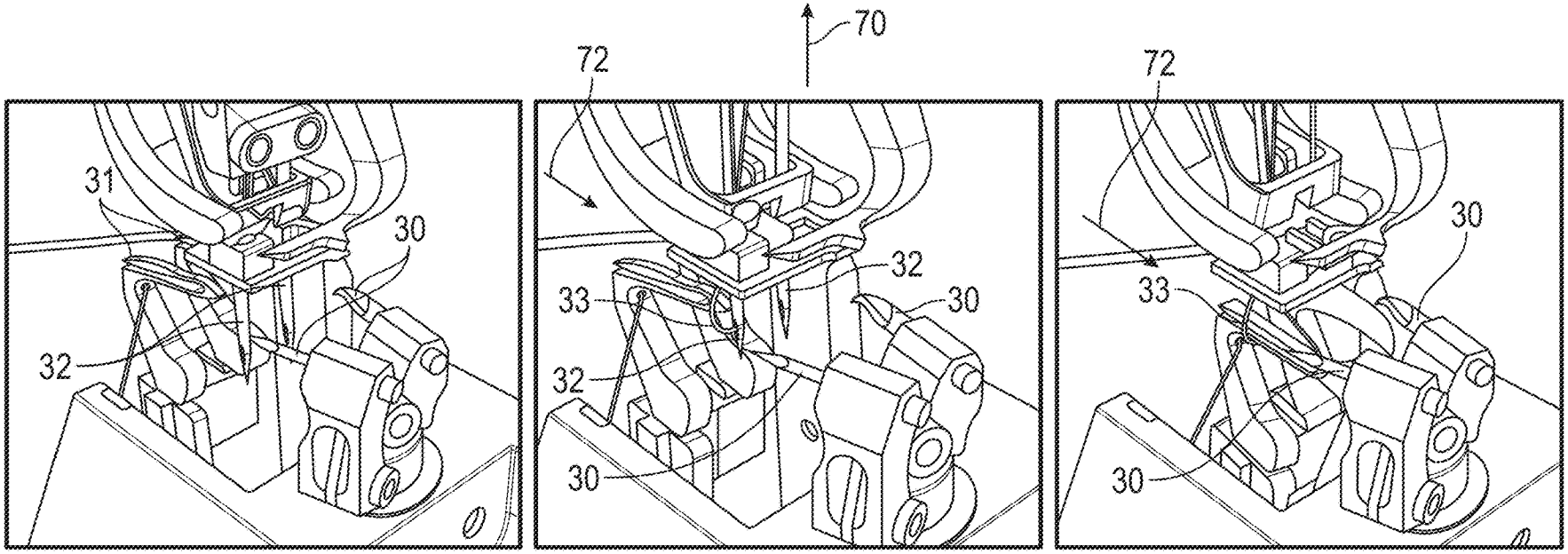

FIG. 7A

- Needle BDC
- Loopers retracted
- Spreaders open

FIG. 7B

- Needles move upward
- Loopers move forward to engage upper thread 33 on needle
- Spreaders remain open

FIG. 7C

- Needles rotate about needle bar during upward movement to TDC to create desired stitch pattern
- Loopers move to full forward position, upper thread looped around rear end of looper
- Spreaders begin to close around lower threads Stitch Formation Sequence

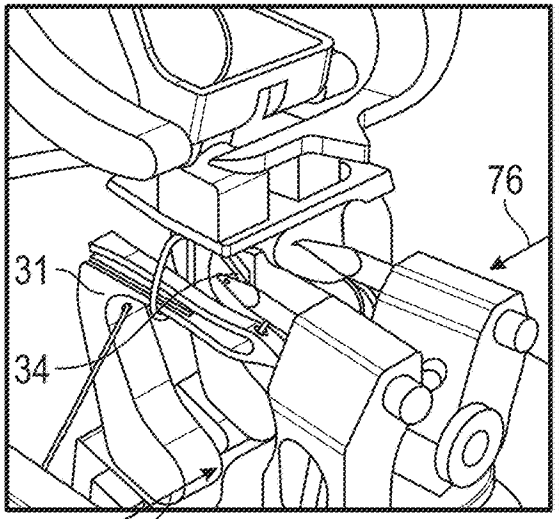

FIG. 7D

- Needles complete rotation as they begin downward motion
- Loopers fully forward
- Spreaders close around lower thread, pulling both lower threads away from their respective loopers

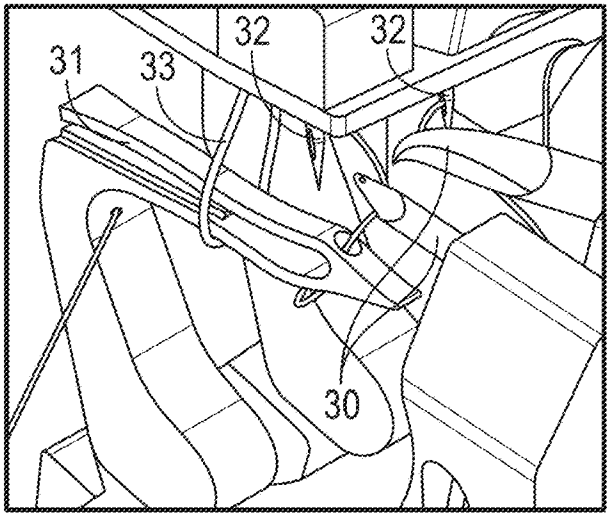

FIG. 7E

- Needles move down through triangle created between lower thread and looper arm
- Loopers begin rearward motion, upper thread still wrapped around looper
- Spreaders are closed with lower thread still retained by spreader tips

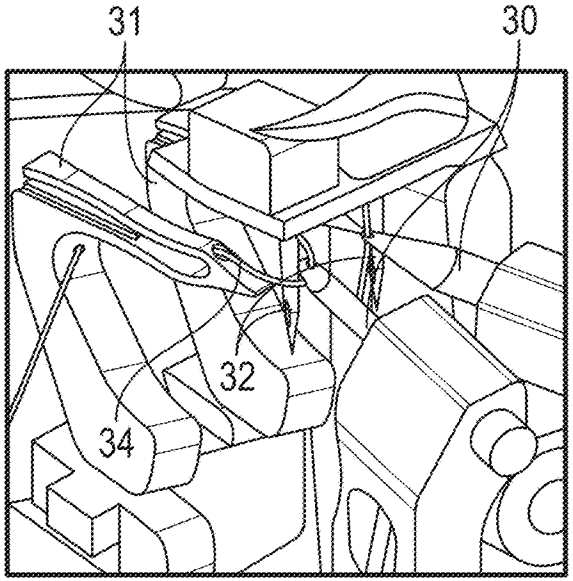

FIG. 7F

- Needles near BDC
- Loopers continue rearward, releasing upper thread
- Spreaders remain closed, lower thread retained

Stitch Formation Sequence

- Needles at BDC
- Loopers moving backward
- Spreaders open releasing lower thread from spreader tip, thereby completing the stitch

- Needles remain at BDC
- Loopers at rearward position
- Spreaders fully open
- Ready for start of next stitch cycle Stitch Formation Sequence - Top View

- Needles 32 BDC
- Loopers 31 retracted
- Spreaders 30 open

Stitch Formation Sequence - Top View

Stitch Formation Sequence - Top View

- Needles rotate about needle bar during upward movement to TDC to create desired stitch pattern
- Loopers move to full forward position, upper thread looped around rear end of looper
- Spreaders begin to close around lower threads 34

Stitch Formation Sequence - Top View

- Needles complete rotation as they begin downward motion
- Loopers fully forward
- Spreaders close around lower thread, pulling both lower threads away from their respective loopers Stitch Formation Sequence - Top View

- Needles move down between triangle 135 created between lower thread and looper arm
- Loopers begin rearward motion, upper thread still wrapped around looper
- Spreaders are closed with lower thread still retained by spreader tips Stitch Formation Sequence - Top View

- Needles near BDC
- Loopers continue rearward, releasing upper thread
- Spreaders remain closed, lower thread retained Stitch Formation Sequence - Top View

- Needles at BDC
- Loopers moving backward
- Spreaders open releasing lower thread from spreader tip, thereby completing the stitch Stitch Formation Sequence - Top View

- Needles remain at BDC
- Loopers at rearward position
- Spreaders fully open
- Ready for start of next stitch cycle

METHOD AND APPARATUS FOR AUTOMATED ORNAMENTAL DECORATIVE STITCHING

CROSS REFERENCE TO RELATED APPLICATIONS

The present application claims the benefit of U.S. Provisional Patent Application Ser. No. 63/357,644 filed on Jul. 1, 2022, the contents of which are incorporated herein by reference thereto.

TECHNICAL FIELD

Exemplary embodiments of the present disclosure pertain to a method and apparatus for sewing a decorative ornamental stitch onto a surface of a three dimensional part.

BACKGROUND

Ornamental stitching of automotive trim materials and parts has been available. Ornamental decorative stitching typically refers a pattern that has some degree of lateral movement of the stitch in addition to forward advancement.

Under current state-of-art, when a decorative ornamental stitch is desired on an automotive trim panel, the stitching is applied via an operator supporting and guiding the part as it is being fed into a manual machine that has been modified to produce any number of different ornamental patterns. The material being sewn can either be flat or pre-shaped. If pre-shaped, the size and shape of the part and the location of the sewing path on the part must be such that a human operator can control placement of the stitch with relative ease.

Many sewing machine manufacturers offer manual sewing equipment used to apply ornamental decorative stitching to trim materials. A manual machine constructed for such stitching can be of the flatbed or post bed variety. Manual flatbed sewing machines are used primarily to sew flat stock material used with the cut-sew-wrap process of cladding a trim component. A manual post bed machine is often utilized to sew parts that have acquired some degree of shape resulting from two components that were join seam sewn together in a prior process step. The post allows the application of the ornamental decorative stitch to the part without the need to flatten the entire part as is normally the case with a flatbed type machine. However, as the part size and/or shape increases, manual sewing of such parts becomes more difficult.

Recent customer requests have included the desire to place an ornamental decorative stitch on 3D preformed automotive parts. As part size and shape complexity increase, particularly in the case of instrument panels, manual sewing of such parts becomes more difficult and at times impossible, driving the need for automation.

BRIEF DESCRIPTION

Disclosed herein is a method and apparatus for robotically sewing a decorative ornamental stitch onto the surface of a 3D shaped part. The ornamental stitch sewing head utilizes chain stitch technology to eliminate the need for frequent lower thread bobbin changes.

Lockstitch technology can also be utilized with consideration of the need for lower bobbin changes and a redesign of the post assembly to accommodate hooks in lieu of loopers.

The sewing head is attached as an end effector to a 6-axis robot which serves to position the sewing head as required relative to the part to be sewn.

Alternatively, the sewing head can be stationary while the robot positions the part relative to the sewing head to execute the stitching process.

Disclosed is an ornamental chain stitching head, including: an upper head assembly, the upper head assembly controls movement of a needle bar and a walking foot mechanism; a walking foot eccentric configured to allow adjustment of a foot lift while a stitch length eccentric is configured to allow for adjustment of both a walking foot and a needle bar advancement via regulation of a rock frame the determines a length of a stitch created by the ornamental chain stitching head; a lower head assembly; and a needle bar cam assembly that drives rotation of the needle bar during each stitch cycle of the ornamental chain stitching head to achieve desired stitch patterns, the needle bar cam assembly is driven directly by an upper shaft through a pair of gears that reduce the needle bar cam assembly speed according to a size ratio of the pair of gears.

In addition to one or more of the features described above, or as an alternative to any of the foregoing embodiments, two different cam profiles are machined into the needle bar cam assembly.

In addition to one or more of the features described above, or as an alternative to any of the foregoing embodiments, a cam follower engages one of the two different cam profiles which in turn drive a linkage that connects to a drive gear.

In addition to one or more of the features described above, or as an alternative to any of the foregoing embodiments, lateral movement of the linkage is managed by two bearing blocks that engage a guide rail.

Also disclosed is an ornamental chain stitching head, including: an upper head assembly, the upper head assembly controls movement of a needle bar and a walking foot mechanism, the needle bar having a pair of needles; and a lower head assembly, the lower head assembly including: a pair of loopers each having a scarf facing each other; and a pair of spreaders, the lower head assembly configured to move pair of loopers towards the pair of spreaders and away from the pair of spreaders during a stitching sequence of the ornamental chain stitching head and the lower head assembly configured to move the pair of spreaders towards and away from each other during the stitching sequence of the ornamental chain stitching head.

In addition to one or more of the features described above, or as an alternative to any of the foregoing embodiments, the pair of needles are received within the pair of loopers during the stitching sequence of the ornamental chain stitching head.

In addition to one or more of the features described above, or as an alternative to any of the foregoing embodiments, the lower head assembly further comprises a pair of concentric shafts rotatably secured to each other such that one of the pair of concentric shafts rotates about the other one of the pair of concentric shafts and the other one of the pair of concentric shafts rotates within the one of the pair of concentric shafts, one of the pair of concentric shafts being operably secured to the one of the pair of spreaders and the other one of the pair of concentric shafts is secured to the other one of the pair of spreaders such that rotation of the pair of concentric shafts with respect to each other causes the pair of spreaders to move towards and away from each other during the stitching sequence of the ornamental chain stitching head.

In addition to one or more of the features described above, or as an alternative to any of the foregoing embodiments, the pair of concentric shafts are rotated by a spreader cam that engages a spreader cam follower which is directly connected to a bearing block, wherein rotation of the spreader cam causes rotation of the pair of concentric shafts with respect to each other.

In addition to one or more of the features described above, or as an alternative to any of the foregoing embodiments, the bearing block rides on a guide rail.

In addition to one or more of the features described above, or as an alternative to any of the foregoing embodiments, the bearing block further includes a pin that serves as a hub for rotatably receiving one end of each of a pair of connecting rods and an opposite end of each of the pair of connecting rods is rotatably secured to one of a pair of crank arms, one of the pair of crank arms is secured to one of the pair of concentric shafts and the other one of the pair of crank arms is secured to the other one of the pair of concentric shafts.

In addition to one or more of the features described above, or as an alternative to any of the foregoing embodiments, linear movement of the bearing block causes rotational movement of the pair of concentric shafts with respect to each other.

Also disclosed is a method of providing a stitch to a part with an ornamental chain stitching head, including: moving a pair of needles up and down with an upper head assembly; and engaging an upper thread of each of the pair of needles with a pair of loopers of a lower head assembly during a stitching sequence of the ornamental chain stitching head, the pair of loopers each having a scarf facing each other; and engaging a lower thread of each of the pair of loopers with a pair of spreaders during the stitching sequence of the ornamental chain stitching head, the lower head assembly moving the pair of loopers towards the pair of spreaders and away from the pair of spreaders during the stitching sequence of the ornamental chain stitching head and the lower head assembly moving the pair of spreaders towards and away from each other during the stitching sequence of the ornamental chain stitching head.

In addition to one or more of the features described above, or as an alternative to any of the foregoing embodiments, the pair of needles are received within the pair of loopers during the stitching sequence of the ornamental chain stitching head.

In addition to one or more of the features described above, or as an alternative to any of the foregoing embodiments, the lower head assembly further comprises a pair of concentric shafts rotatably secured to each other such that one of the pair of concentric shafts rotates about the other one of the pair of concentric shafts rotates and the other one of the pair of concentric shafts rotates within the one of the pair of concentric shafts, one of the pair of concentric shafts being operably secured to the one of the pair of spreaders and the other one of the pair of concentric shafts is secured to the other one of the pair of spreaders such that rotation of the pair of concentric shafts with respect to each other causes the pair of spreaders to move towards and away from each other during the stitching sequence of the ornamental chain stitching head.

In addition to one or more of the features described above, or as an alternative to any of the foregoing embodiments, the pair of concentric shafts are rotated by a spreader cam that engages a spreader cam follower which is directly connected to a bearing block, wherein rotation of the spreader cam causes rotation of the pair of concentric shafts with respect to each other.

In addition to one or more of the features described above, or as an alternative to any of the foregoing embodiments, the bearing block rides on a guide rail.

In addition to one or more of the features described above, or as an alternative to any of the foregoing embodiments, the bearing block further comprises a pin that serves as a hub for rotatably receiving one end of each of a pair of connecting rods and an opposite end of each of the pair of connecting rods is rotatably secured to one of a pair of crank arms, one of the pair of crank arms is secured to one of the pair of concentric shafts and the other one of the pair of crank arms is secured to the other one of the pair of concentric shafts.

In addition to one or more of the features described above, or as an alternative to any of the foregoing embodiments, linear movement of the bearing block causes rotational movement of the pair of concentric shafts with respect to each other.

In addition to one or more of the features described above, or as an alternative to any of the foregoing embodiments, movement of the pair of loopers and the pair of spreaders is limited to an area defined by a stitch plate having a width of 35 mm or less and a length of 56 mm or less during the stitching sequence of the ornamental chain stitching head, In addition to one or more of the features described above, or as an alternative to any of the foregoing embodiments, the pair of needles are received within the pair of loopers during the stitching sequence of the ornamental chain stitching head and the lower head assembly further comprises a pair of concentric shafts rotatably secured to each other such that one of the pair of concentric shafts rotates about the other one of the pair of concentric shafts rotates and the other one of the pair of concentric shafts rotates within the one of the pair of concentric shafts, one of the pair of concentric shafts being operably secured to the one of the pair of spreaders and the other one of the pair of concentric shafts is secured to the other one of the pair of spreaders such that rotation of the pair of concentric shafts with respect to each other causes the pair of spreaders to move towards and away from each other during the stitching sequence of the ornamental chain stitching head.

BRIEF DESCRIPTION OF THE DRAWINGS

The following descriptions should not be considered limiting in any way. With reference to the accompanying drawings, like elements are numbered alike:

FIGS. 7A-7H illustrate a stitch formation cycle in accordance with the present disclosure.

DETAILED DESCRIPTION

A detailed description of one or more embodiments of the disclosed apparatus and method are presented herein by way of exemplification and not limitation with reference to the Figures.

As mentioned above and when a decorative ornamental stitch is desired on an automotive trim panel and as the part size and/or shape increases, manual sewing of such parts becomes more difficult. As such and as part size and shape complexity increase, particularly in the case of instrument panels, manual sewing of such parts becomes more difficult and at times impossible, driving the need for automation.

Disclosed herein is a method and apparatus for robotically sewing a decorative ornamental stitch onto the surface of a 3D shaped part. Non-limiting examples of the three dimensional part include, vehicle interiors, vehicle instrument panels, any automotive interior surfaces or any other part that has limited access on an opposite side of the item to be sewn due to the configuration of the part or panel to be sewn. The part or panel to be sewn may comprise several layers or only a single layer, in one embodiment, the part or panel may have as an exterior show surface having a substantially smooth outer surface and an underside facing away from the outer surface. The exterior show surface may be formed of a plastic material, vinyl, thermoplastic olefin TPO, leather etc. of substantial flexibility and aesthetically pleasing character.

In order to enhance the softness of part or panel, a layer of cushioning support material may be added to the part or panel before or after the part is sewn. The part or panel may also include a substrate panel of dimensionally stable plastic or other suitable material applied before or after the stitching process. Still further and in one embodiment, the part or panel may only comprise a single layer of the structural panel.

The ornamental stitch sewing head utilizes chain stitch technology to eliminate the need for frequent lower thread bobbin changes.

Lockstitch technology can also be utilized with consideration of the need for lower bobbin changes and a redesign of the post assembly to accommodate hooks in lieu of loopers.

The sewing head is attached as an end effector to a 6-axis robot which serves to position the sewing head as required relative to the part to be sewn.

Alternatively, the sewing head can be stationary while the robot positions the part relative to the sewing head to execute the stitching process.

Figure 1:
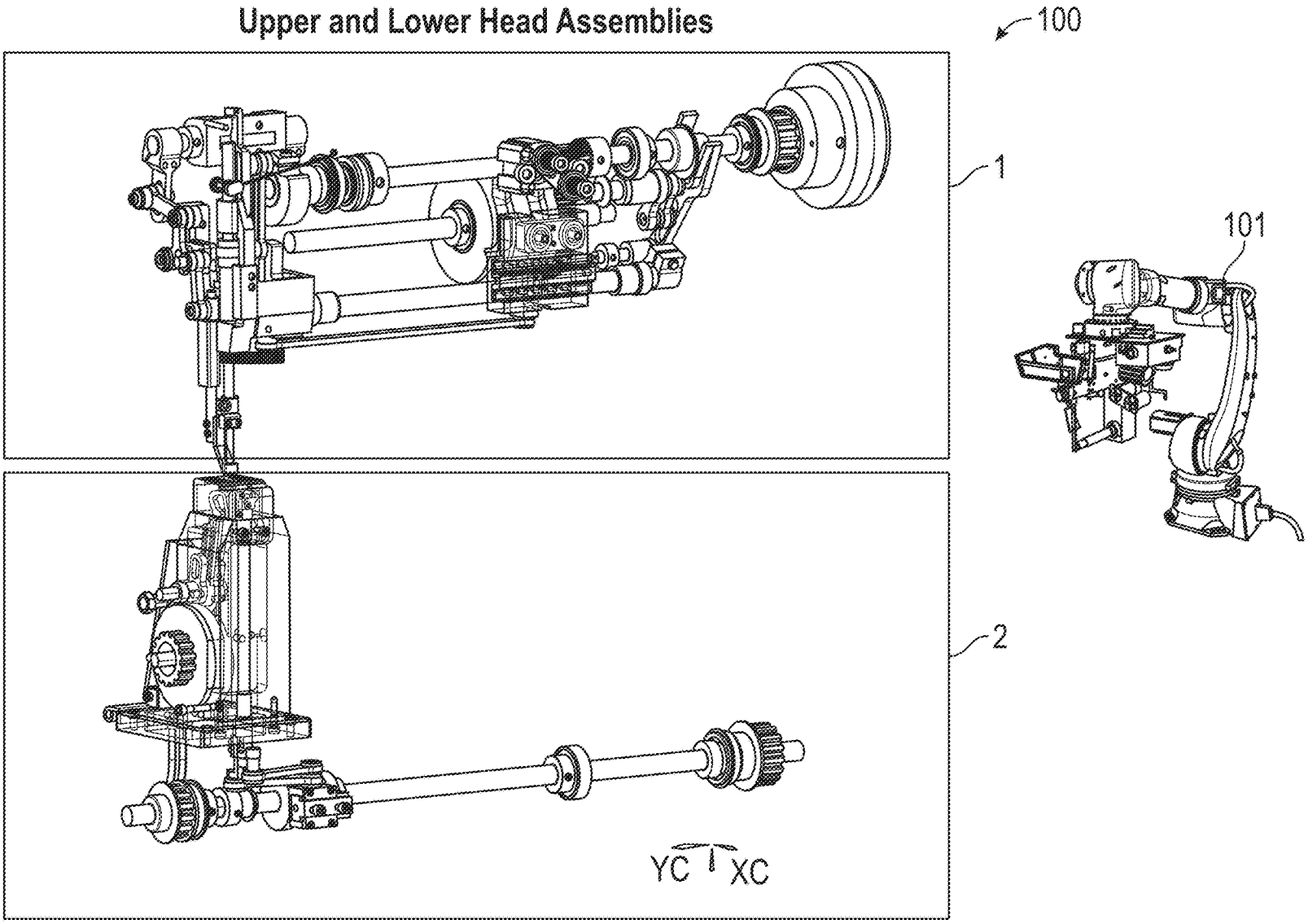
FIG. 1 is a perspective view of an ornamental chain stitching head in accordance with the present disclosure.

FIG. 1 is a perspective view of an ornamental chain stitching head in accordance with the present disclosure.

Figure 2:
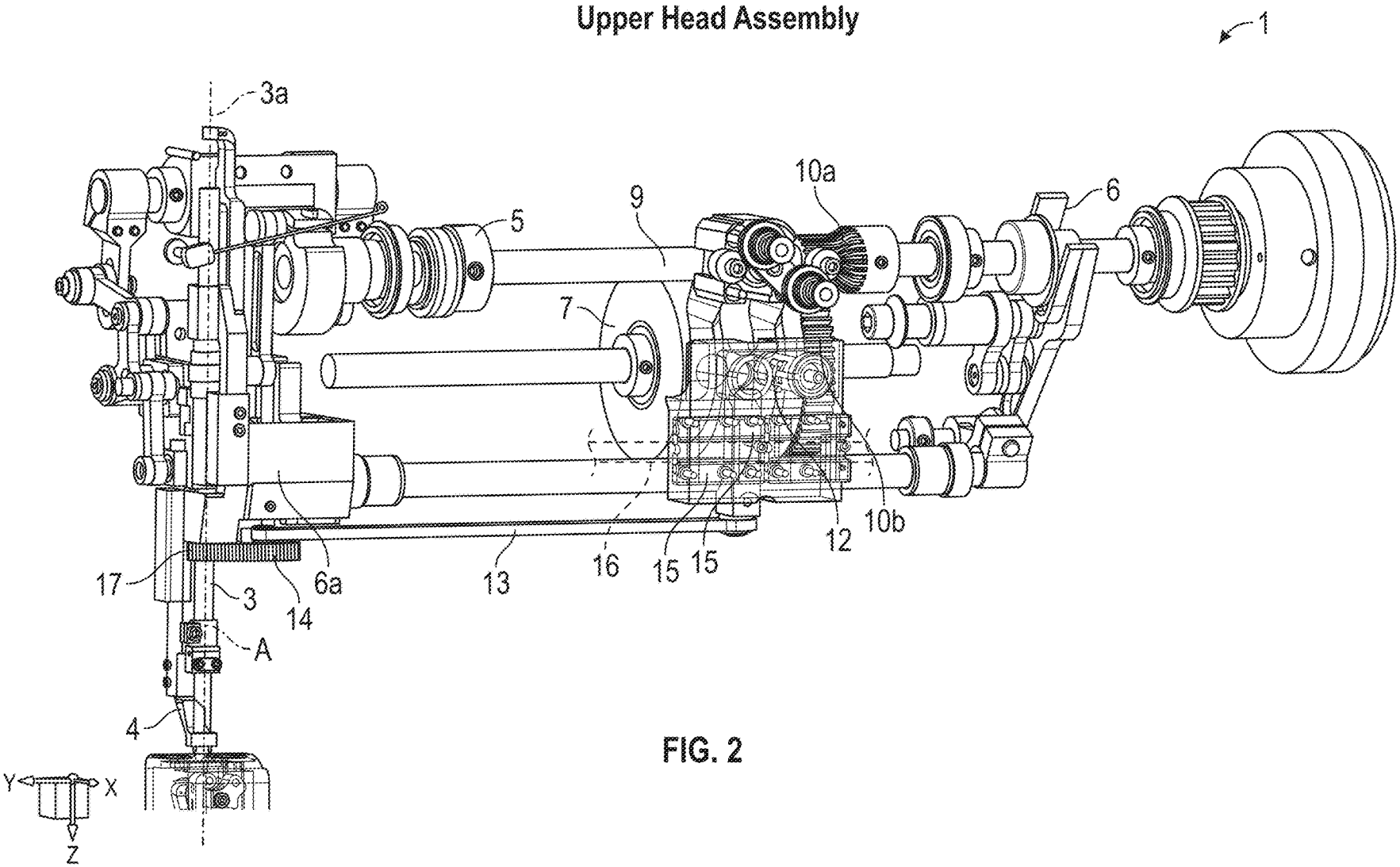
FIG. 2 is a perspective view of an upper head assembly of the ornamental chain stitching head illustrated in FIG. 1.

FIG. 2 is a perspective view of an upper head assembly of the ornamental chain stitching head illustrated in FIG. 1.

Figure 3:
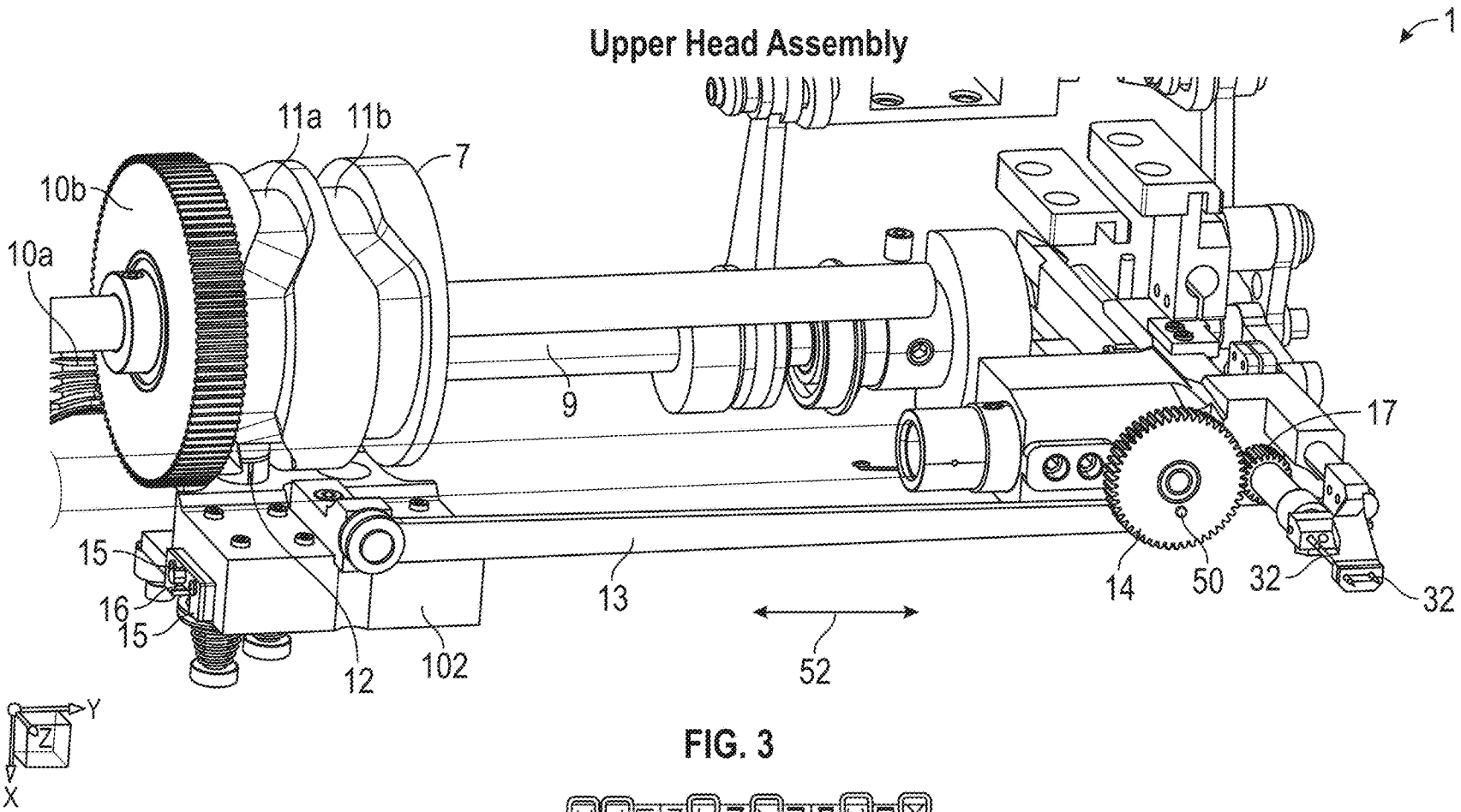
FIG. 3 is an enlarged perspective view of a portion of the upper head assembly of the ornamental chain stitching head illustrated in at least FIG. 2.

FIG. 3 is an enlarged perspective view of a portion of the upper head assembly of the ornamental chain stitching head illustrated in at least FIG. 2.

Figure 3A:
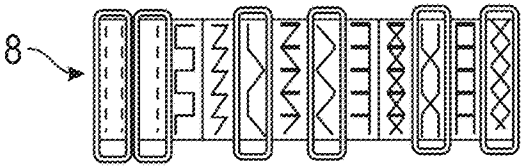

FIG. 3A illustrates stitch patterns capable of being made with the ornamental chain stitching head in accordance with the present disclosure.

Figure 4:
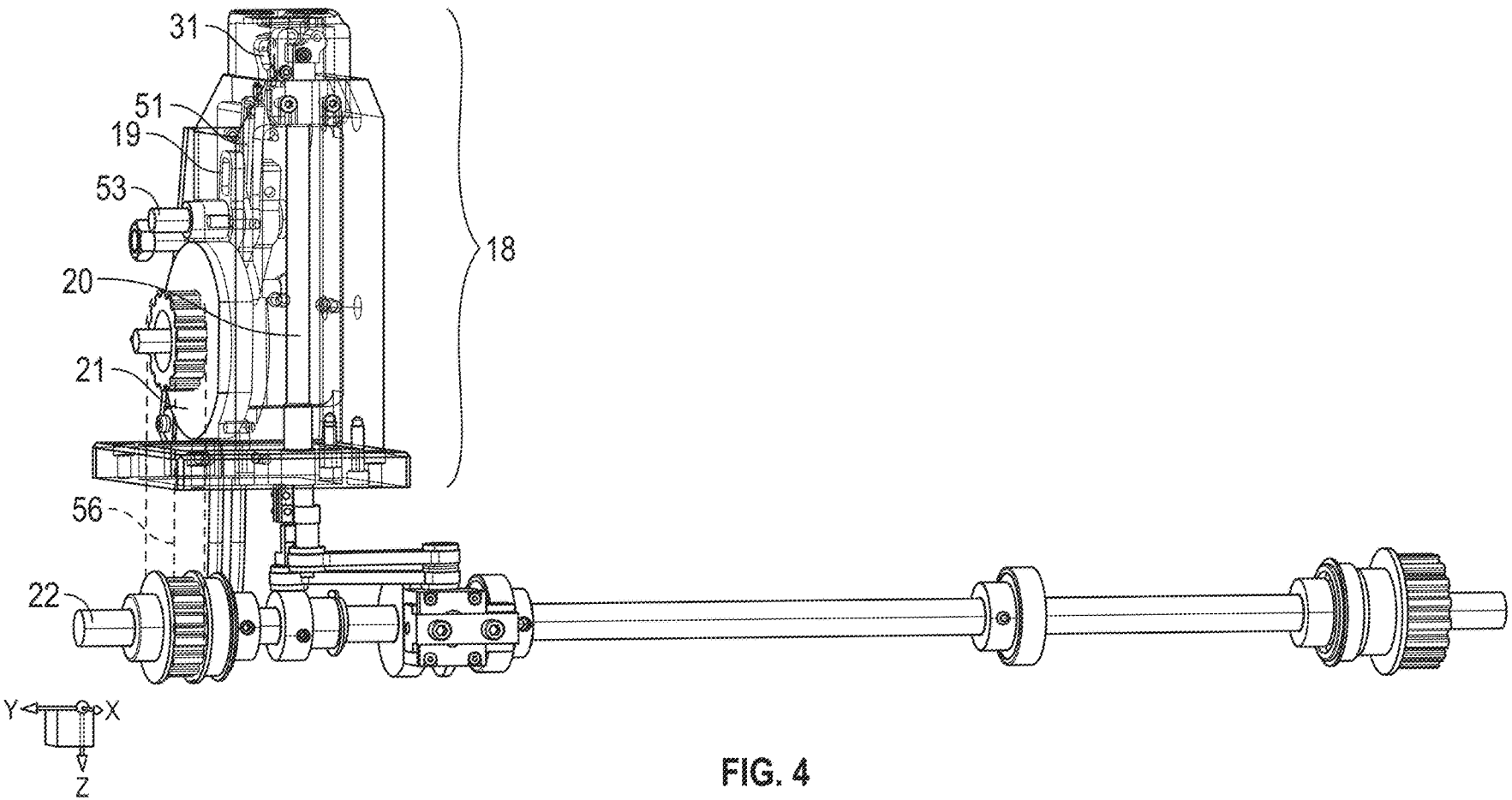
FIG. 4 is a perspective view of a lower head assembly of the ornamental chain stitching head illustrated in FIG. 1.

FIG. 4 is a perspective view of a lower head assembly of the ornamental chain stitching head illustrated in FIG. 1.

Figure 5:
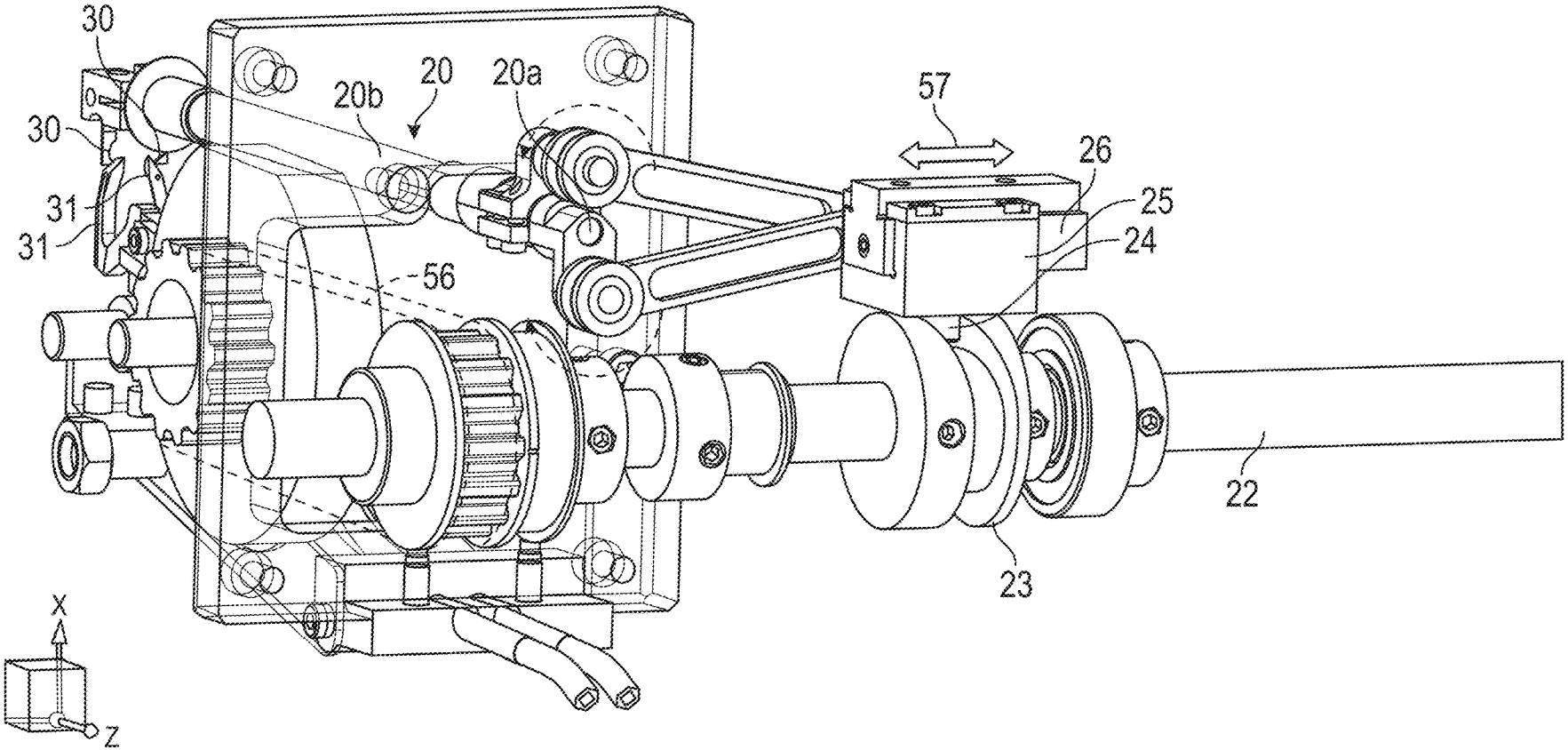
FIG. 5 is an enlarged perspective view of a portion of the lower head assembly of the ornamental chain stitching head illustrated in at least FIG. 4.

FIG. 5 is an enlarged perspective view of a portion of the lower head assembly of the ornamental chain stitching head illustrated in at least FIG. 4.

Figure 6:
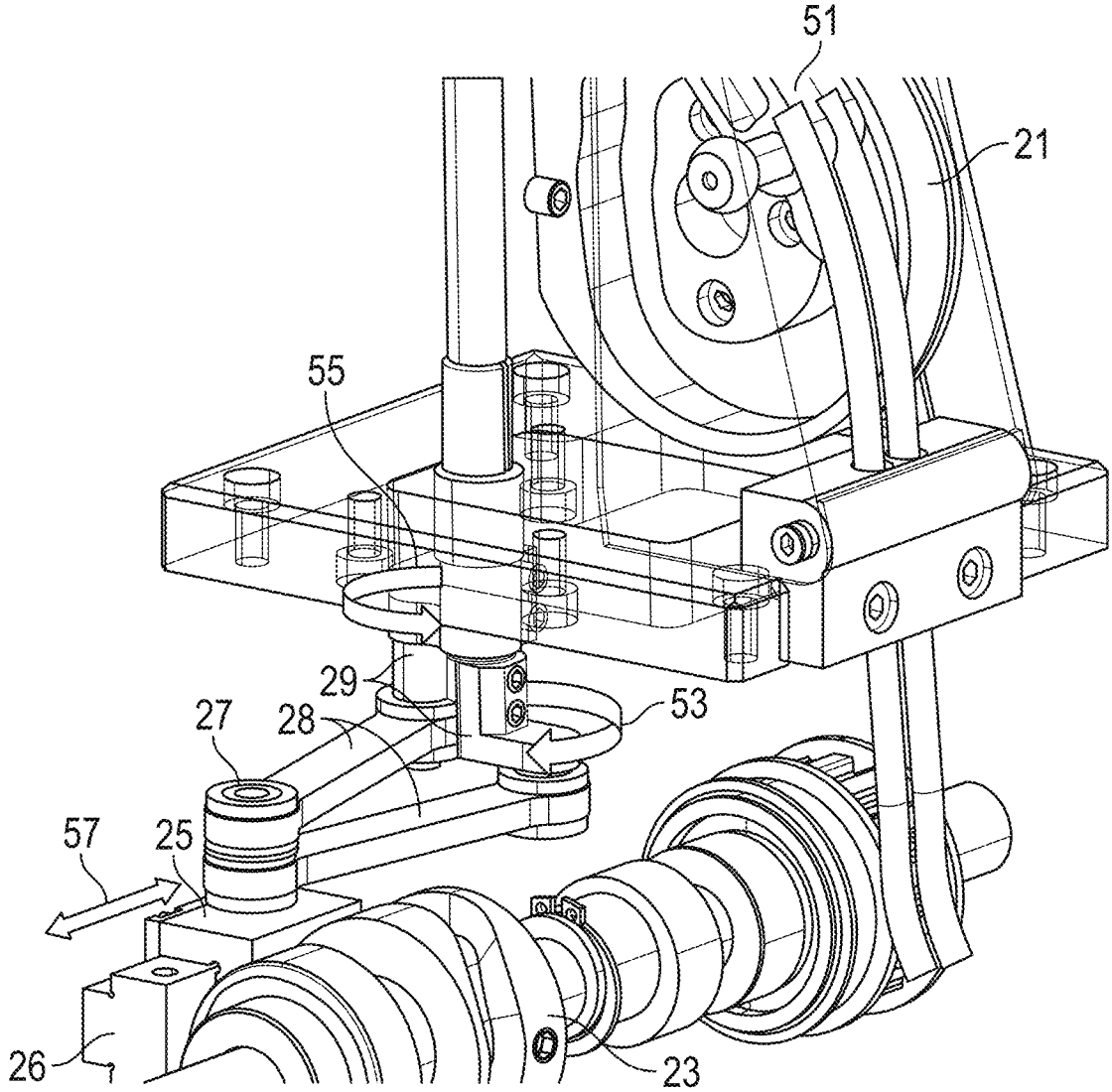
FIG. 6 is an enlarged perspective view of a portion of the lower head assembly of the ornamental chain stitching head illustrated in at least FIG. 4.

FIG. 6 is an enlarged perspective view of a portion of the lower head assembly of the ornamental chain stitching head illustrated in at least FIG. 4.

FIGS. 7A-7H illustrate a stitch formation cycle in accordance with the present disclosure.

Figure 8:
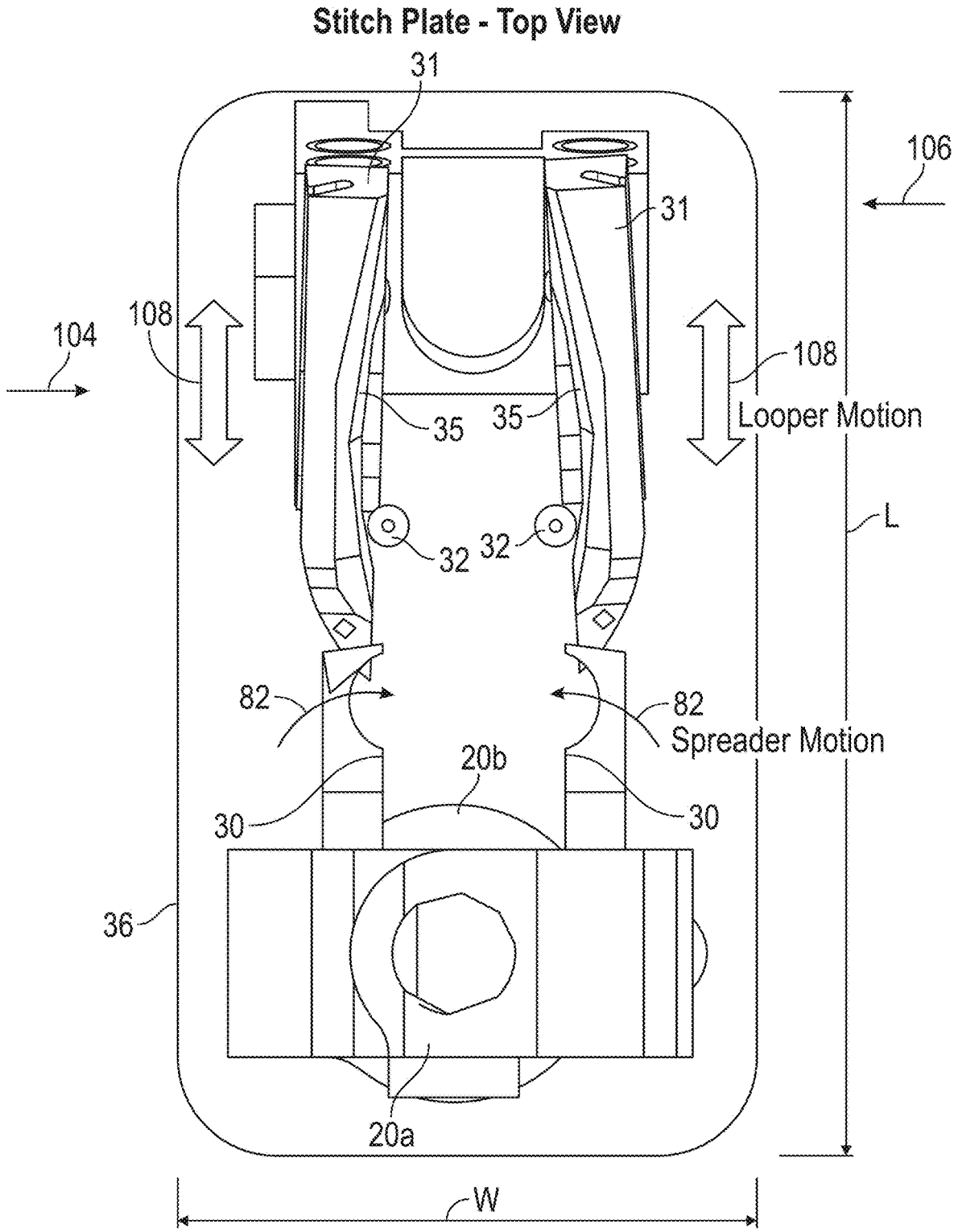
FIG. 8 illustrates a top of a stitch plate of the lower head assembly of the present disclosure.

FIG. 8 illustrates a top of a stitch plate of the lower head assembly of the present disclosure.

FIGS. 9A-9H illustrate a top view of the stitch formation cycle in accordance with the present disclosure.

Referring to FIG. 1, an ornamental chain stitch sewing head 100 of the present disclosure is illustrated. In accordance with an embodiment of the present disclosure, the ornamental chain stitch sewing head 100 is contemplated to be used a head of a robot stitching machine. In one embodiment, the ornamental chain stitch sewing head 100 is attached as an end effector to a 6-axis robot 101 (illustrated pictorially) which serves to position the sewing head 100 as required relative to a part to be sewn. Alternatively, the sewing head can be stationary while the robot positions the part relative to the sewing head 100 to execute the stitching process. The ornamental chain stitch sewing head 100 includes an upper head assembly 1 and a lower head assembly 2.

As shown in FIG. 2, the upper head assembly 1 controls the movement of a needle bar 3 and a walking foot 4 mechanism. A walking foot eccentric 5 allows adjustment of a foot lift while a stitch length eccentric 6 allows adjustment of both the walking foot and needle bar advancement via regulation of a rock frame 6*a* which determines the length of the stitch.

A needle bar cam 7 assembly drives rotation of the needle bar 3 about an axis A during each stitch cycle to achieve desired stitch patterns 8 illustrated in FIG. 3A. The needle bar cam 7 is driven directly by an upper shaft 9 through a pair of gears 10*a* and 10*b* that reduce the cam speed according to the size ratio of the two gears 10*a*, 10*b*. Two different cam profiles 11*a*, 11*b* are machined into the cam shown in FIG. 3. Other profiles can be integrated in addition to those shown or can be replace existing cams located within the sewing head.

A cam follower 12 engages one of the two cam profiles 11*a*, 11*b* which in turn drive a linkage 13 connected to the cam follower 12 at one end and the linkage 13 is connected to a drive gear 14 at another end via a pin 50 such that linear movement of the linkage in the direction of arrows 52 causes rotational movement of gear 50. Smooth lateral movement of the linkage 13 in the direction of arrows 52 is managed by two bearing blocks 15 that engage a guide rail 16 that slides between the two bearing blocks 15. A portion of the guide rail 16 is illustrated by the dashed lines in FIG. 2. The bearing blocks 15 are secured to block 102 that is secured to the linkage 13 and the cam follower 12. The drive gear 14 engages a driven gear 17 that surrounds and is secured to the needle bar 3 and thus rotates the needle bar 3 about axis A as dictated by the selected cam gear profile 11*a*, 11*b* during machine operation (e.g., rotation of shaft 9 by motor or other device operably coupled shaft 9).

Alternatively, needle bar rotation can be controlled via pneumatic or electrical actuation in lieu of the aforementioned cams.

The lower head assembly 2 is shown in FIG. 4 and incorporates a post assembly 18 which houses a looper drive mechanism 19 and a spreader shaft assembly 20. A looper cam 21 controls all rotary movement of a looper arm 51 that is rotatably secured to a shaft 53. The looper arm 51 engages the looper cam 21 at one end and is secured to a pair of loopers 31 at another end of the looper arm 51. As such, looper 31 position as well as acceleration and deceleration of the loopers is controlled by rotation of the looper cam 21. The looper cam 21 is driven directly from a belt 56 (illustrated by dashed lines) operably connected to a lower arm shaft 22 and the looper cam 21. The lower arm shaft 22 is rotated by a motor or other equivalent device operably coupled to the lower arm shaft 22. Thus, rotation of the looper cam 21 causes movement of the loopers 31 via movement of the looper arm 51 (e.g., a cam follower of the looper arm 51 engages a cam path of the looper cam 21 as the looper cam 21 is rotated thus the looper arm 51 rotates about shaft 53 as the looper cam 21 is rotated and the looper 31 position is varied).

In FIG. 5, the spreader shaft assembly 20 includes a pair of concentric shafts or spreader shafts 20*a*, 20*b* rotatably secured to each other (e.g., shaft 20*b* is disposed about shaft 20*a* and shaft 20*b* rotates about shaft 20*a*). In other words, shaft 20*a* has an external circular periphery that is slightly smaller than an inner diameter of an inner opening of shaft 20*b* which shaft 20*a* is received in. Both shafts 20*a*, 20*b* are driven by a spreader cam 23 which is located at the base of the post on the lower shaft. The spreader cam 23 engages a spreader cam follower 24 which is directly connected to a bearing block 25 that rides on a guide rail 26 to ensure smooth linear actuation.

At the top of the bearing block 25 in FIG. 6 is a pin 27 that serves as a hub for rotatably receiving one end of a pair of connecting rods 28. The opposite end of each of the pair of connecting rods 28 is rotatably or operably coupled to one of a pair of crank arms 29 one of the pair of crank arms 29 is secured to one of the pair of concentric shafts 20*a*, 20*b* and the other one of the pair of crank arms 29 is connected to the other one of the pair of concentric shafts 20*a*, 20*b*. As such, the pair of crank arms 29 and the pair of connecting rods 28 operably couple the pair of concentric shafts 20*a*, 20*b* to the spreader cam 23 such that rotation of the spreader cam 23 causes rotational movement of the pair of concentric shafts 20*a*, 20*b* in the direction of arrows 53, 55 with respect to each other. As such, linear motion of the bearing block 25 via pin 24 engaging the spreader cam 23 in the direction of arrows 57 translates into rotary motion of each spreader shaft 20*a*, 20*b* or concentric shafts 20*a*, 20*b* in a direction opposite to one another. This rotational movement of the spreader shafts 20*a*, 20*b* will also cause rotational of spreaders 30 secured to opposite ends of the concentric shafts 20*a*, 20*b*.

Figure 7G:
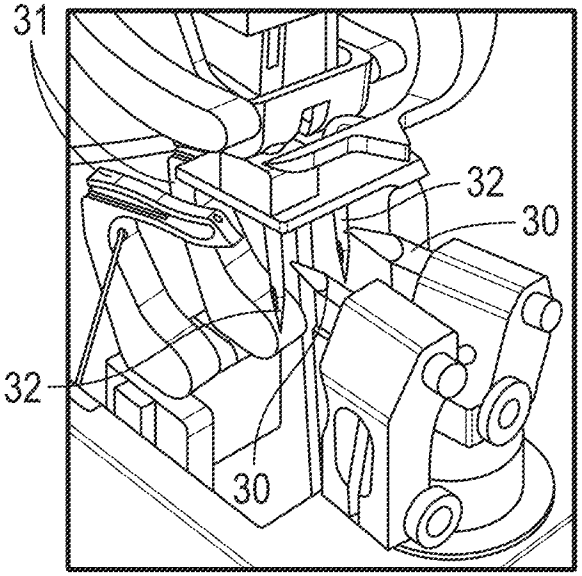

A description of a stitch formation cycle using the ornamental chain stitch sewing head 100 of the present disclosure is shown in at least FIGS. 7A-7H. FIG. 7A illustrates needles 32 at a bottom dead center (BDC) position, and loopers 31 retracted or in a rearward position, and spreaders 30 are fully open (e.g., fully separated from each other) at the start of a stitch cycle. It being understood that during the stitch cycle, the loopers 31 move between the rearward position and a forward position while the spreaders 30 move between the fully open position and a closed position wherein the spreaders 30 are moved closer to each other than the fully open position. It being understood that the spreaders need not contact each other when they are in the closed position.

In FIG. 7B, the needles 32 begin their upward movement in the direction of arrow 70 while the loopers 31 move forward in the direction of arrow 72 (e.g., due rotation of the looper cam 21) from the rearward position of FIG. 7A to pick a top thread or upper thread 33 of the stitch from each one of the needles 32 (e.g., each needle 32 has a top thread or upper thread 33). During this movement the spreaders 30 remain stationary in their open position.

FIG. 7C shows the loopers 31 in their fully forward position in the direction of arrow 72 with the top thread 33 and the spreaders 30 still in full open position. The needles 32 begin rotation about the needle bar axis 3*a* (due to rotation of gears 14 and 17 as discussed above) as they approach their top dead center (TDC) position. Here each upper thread or top thread 33 is looped around a rear end of a respective looper 31 and the loopers move to a full forward position and the spreaders 30 begin to close about a respective lower thread 34.

In FIG. 7D, needle rotation is completed as the needles 32 move downward from their top dead center (TDC) position in a direction opposite to arrow 70. Here the spreaders 30 are closing (e.g., moving towards each other in the direction of arrows 76 (due to rotation of spreader shaft 20*a*, 20*b* or concentric shafts 20*a*, 20*b* as discussed above), pulling a bottom thread 34 away from each looper 31 (e.g., each looper 31 feeding a bottom thread 34). Here the loopers 31 are both still in their fully forward position. Movement of the spreaders 30 towards and away from each other is facilitated by the rotational movement each spreader shaft or concentric shaft 20*a*, 20*b* with respect to each other as one of the shafts 20*a*, 20*b* is secured to one of the spreaders 30 and the other one of the shafts 20*a*, 20*b* is secured to the other one of the spreaders 30. Thus, rotation of the shafts 20*a*, 20*b* causes the spreaders 30 to move towards and away from each other.

FIG. 7E illustrates each needle 32 moving down through a triangle created between a respective bottom thread 34 of a respective looper 31. Here, the top thread 33 is still wrapped around the loopers 31 as they begin rearward motion in a direction opposite to arrow 72 from their fully forward position illustrated in at least FIG. 7C. Here the spreaders 30 are fully closed and retain the bottom thread 34 (e.g., a hook portion at a distal end of each spreader 30 engages a respective one of the bottom thread 34 provided by a respective looper 31).

In FIG. 7F, the needles 32 approach bottom dead center (BDC) while the loopers 31 move rearward to the point where the top thread 33 is released from a tip or distal end of the looper 31. Here the spreaders 30 remain closed or close to each other with a respective lower or bottom thread 34 is retained by a respective spreader 30 of the pair of spreaders.

In FIG. 7G the spreaders 30 move in a direction opposite to arrows 76 to the point where the lower thread 34 is released from tips or distal ends of the spreaders 30, thereby completing the stitch. The loopers 31 continue to move rearward in a direction opposite to arrows 72 while the spreaders 30 move in a direction opposite to arrows 76 towards their full open position and the needles 32 are at their bottom dead center (BDC) position.

Figure 7H:
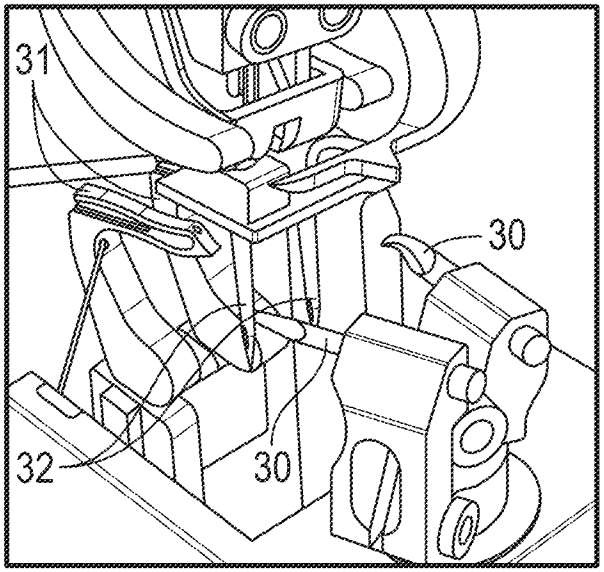

In FIG. 7H, the loopers 31 are fully rearward, the spreaders 30 are fully open, and the needles 32 remain at their bottom dead center (BDC) position, ready for the start of the next stitch cycle where the needles 32 will once again begin their upward movement in the direction of arrow 70.

In FIG. 8, a top view of a stitch plate 36 of the ornamental chain stitch sewing head 100 is illustrated. The view illustrated in FIG. 8 is one of the positions during the stitch sequence described above. As illustrated, the loopers 31 are configured and positioned so that a scarf 35 of each looper 31 faces one another (e.g., in the directions of arrows 104, 106 as opposed to both scarfs 35 facing in the same direction of arrow 104 or 106). This looper orientation allows both needles 32 to pass to the inside of each looper 31 or in between both loopers 31 as illustrated, as opposed to scarfs 35 that face the same direction wherein only one needle 32 would pass between the two loopers as the other needle 32 would have to engage the other scarf 35 facing in the same direction as the other scarf 35 and the spreaders 30 move rotationally in opposite directions with respect to each other in the direction of arrows 82 (e.g., in and out or open and closed) instead of laterally in the same direction in front of the tips of the loopers 31, which would be required if the scarfs 35 face in the same directions as opposed to facing each other in accordance with the present disclosure. In other words, and in the present disclosure, the scarfs 35 face each other (e.g., opposing faces) as opposed to scarfs 35 that face in the same general direction. This configuration in combination with the rotating concentric spreader shafts 20*a*, 20*b*, minimizes the package space requirements at the top of lower post.

Also illustrated, is that the loopers 31 move between the rearward and forward positions in the directions of arrows 108.

In one embodiment and in view of the configuration of the present disclosure, the stitch plate 36 width "W" by length "L" can be 35 mm×56 mm or less to allow for passage of the stitch plate 36 through restricted or small areas of three-dimensional parts during sewing. This configuration also eliminates any tendency for the thread to untwist during sewing.

While the aforementioned configurations of a width "W" of 35 mm by a length "L" of 56 mm has been shown to provide desired results the present disclosure is also contemplated for use dimensions smaller or greater than the aforementioned dimensions.

Frequency of needle bar rotation and the use of one versus two needles dictates the type of stitch pattern produced.

Referring now to FIGS. 9A-9H, top views of the stitch formation cycle in accordance with the present disclosure are illustrated.

Figure 9A:
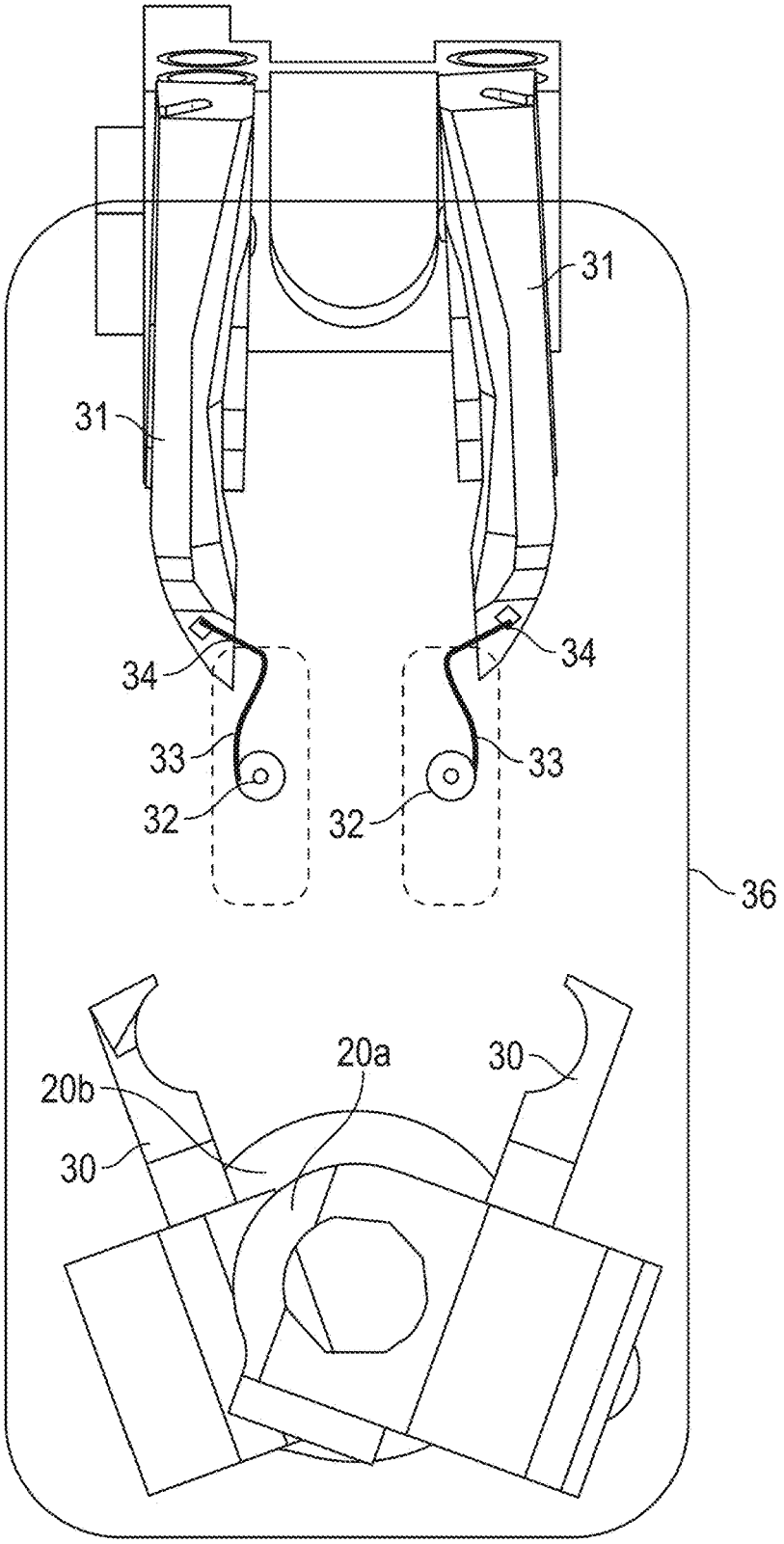
FIGS. 9A-9H illustrate a top view of the stitch formation cycle in accordance with the present disclosure.
Figure 9B:
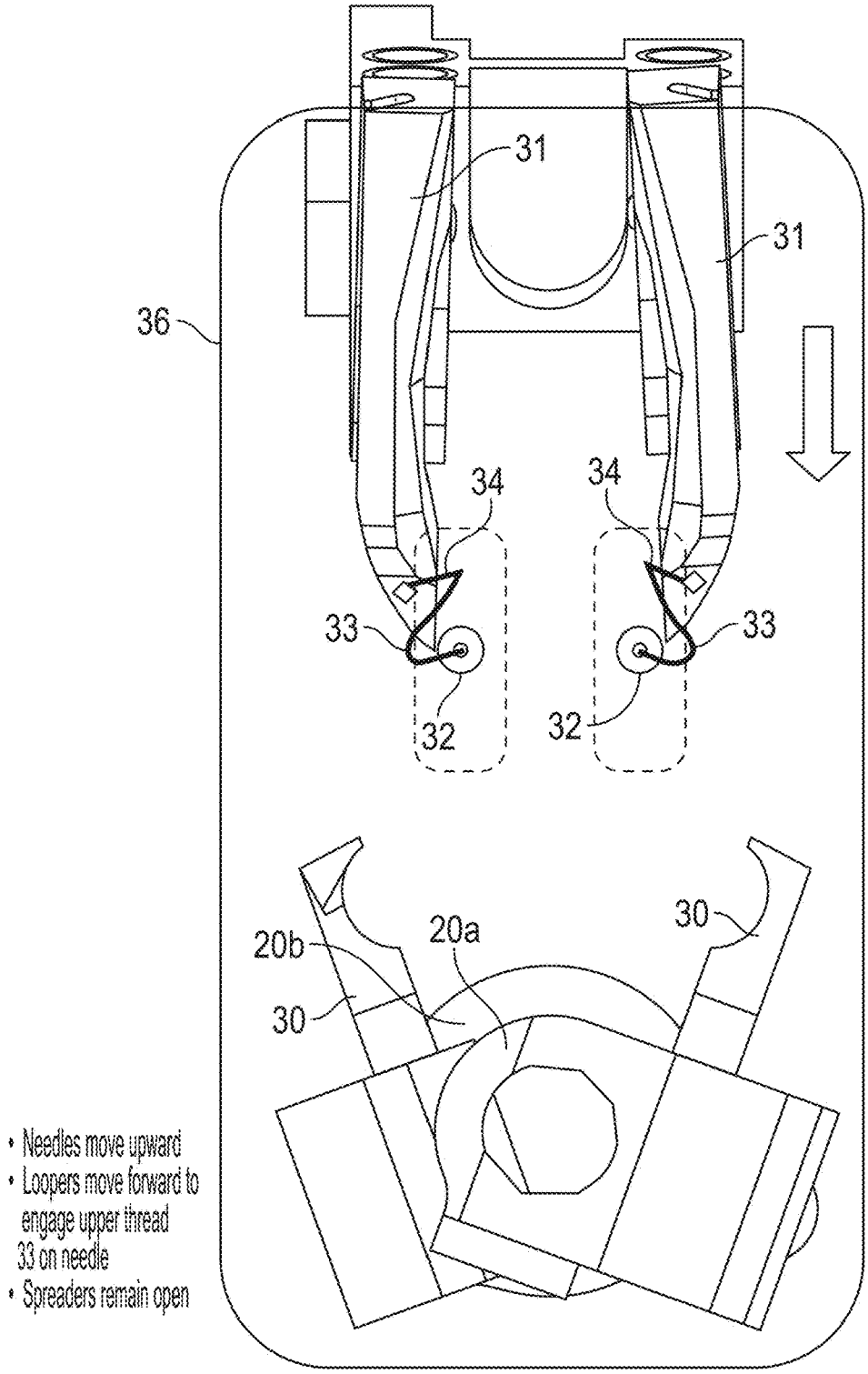
Figure 9C:
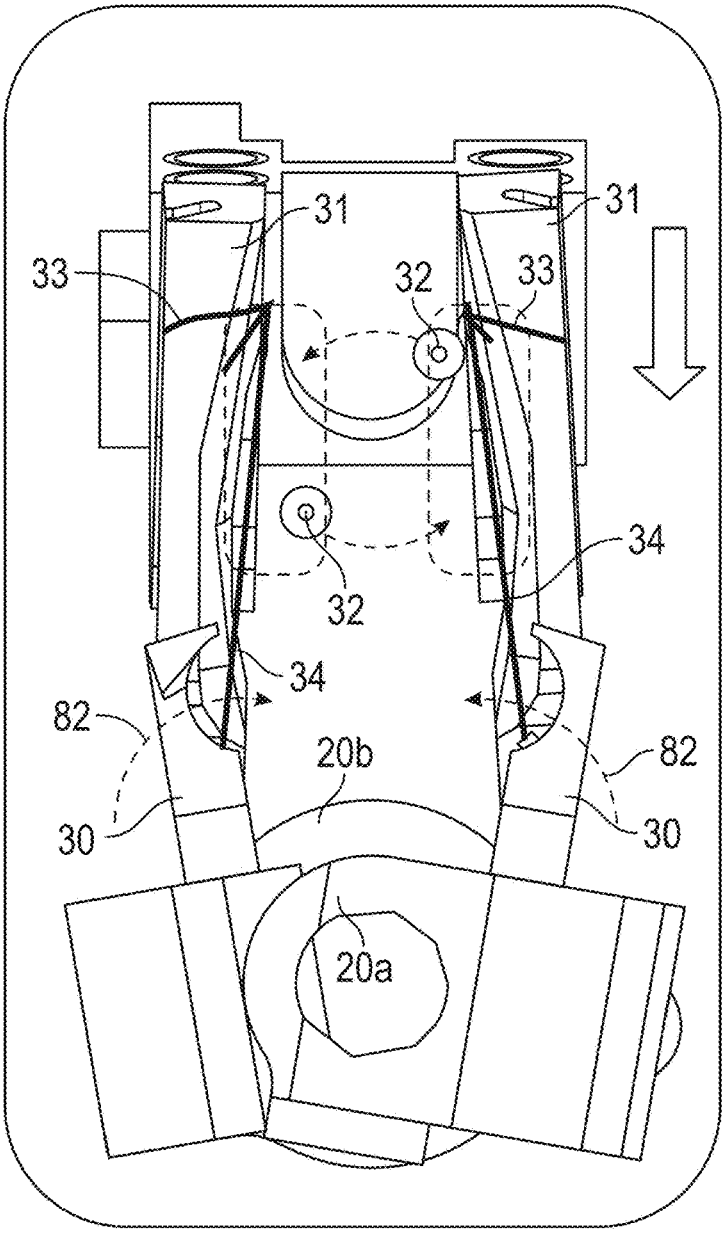

In FIG. 9A, the needles 32 are at bottom dead center and the loopers 31 are retracted and the spreaders 30 are open. In FIG. 9B, the needles 32 move upward and the loopers 31 move forward to engage the upper threads 33 and the spreaders 30 remain in the open position. In FIG. 9C, the needles 32 rotate about the needle bar 3 during their upward movement towards top dead center to create a desired stitch pattern and the loopers 31 move to a full forward position and the upper thread 33 is looped around a rear end of the looper 31. In addition, the spreaders 30 will move towards each other in the direction of arrows 82 and engage the lower threads 34.

Figure 9D:
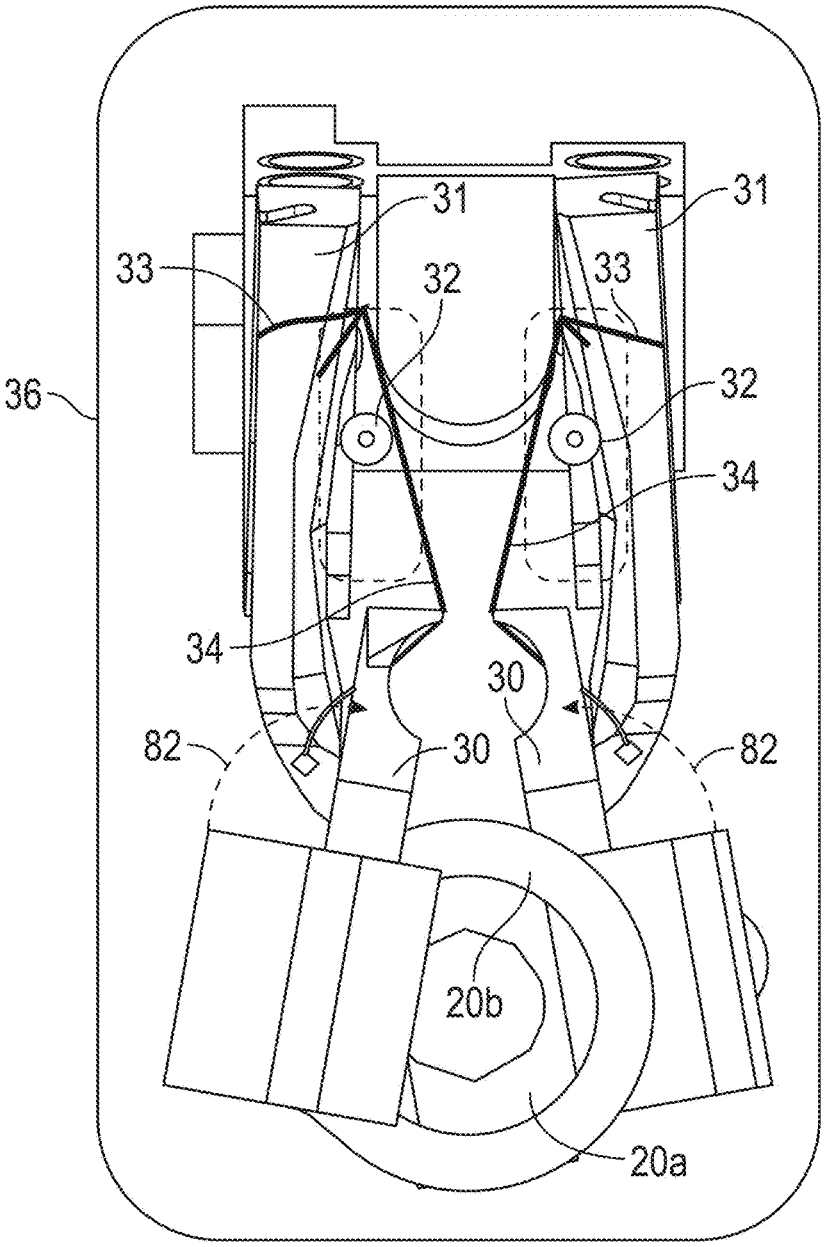
Figure 9E:
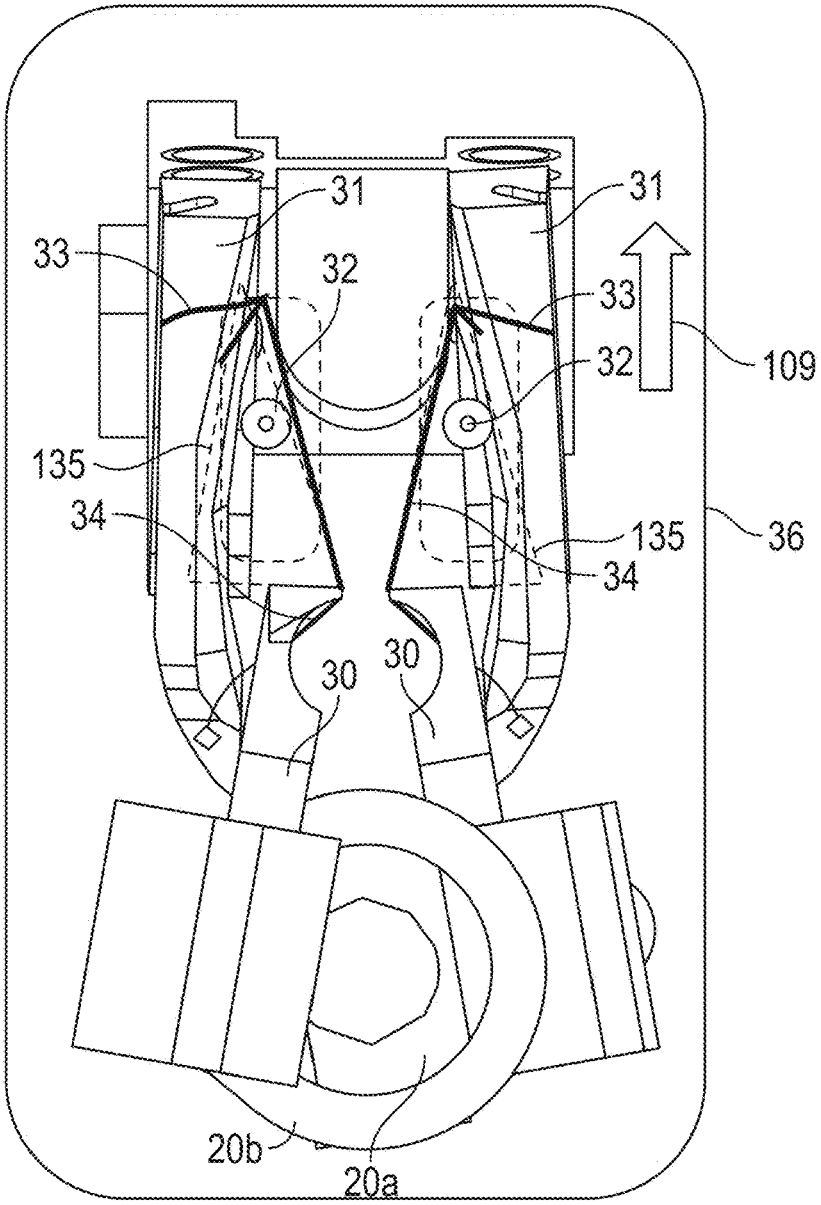

In FIG. 9D, the needles 32 complete their rotation as they begin their downward motion. Here the loopers 31 are fully forward and the spreaders 30 close around a respective lower thread 34 pulling it away from its respective looper 31. In FIG. 9E, the needles 32 are moving down between a triangle 135 created between lower thread 34 and a respective arm of a looper 31 and the loopers 31 begin rearward motion, with the upper thread 33 still wrapped around looper 31. Here the spreaders 30 are closed with a respective lower thread 34 still retained by the tips of the spreaders 30.

Figure 9F:
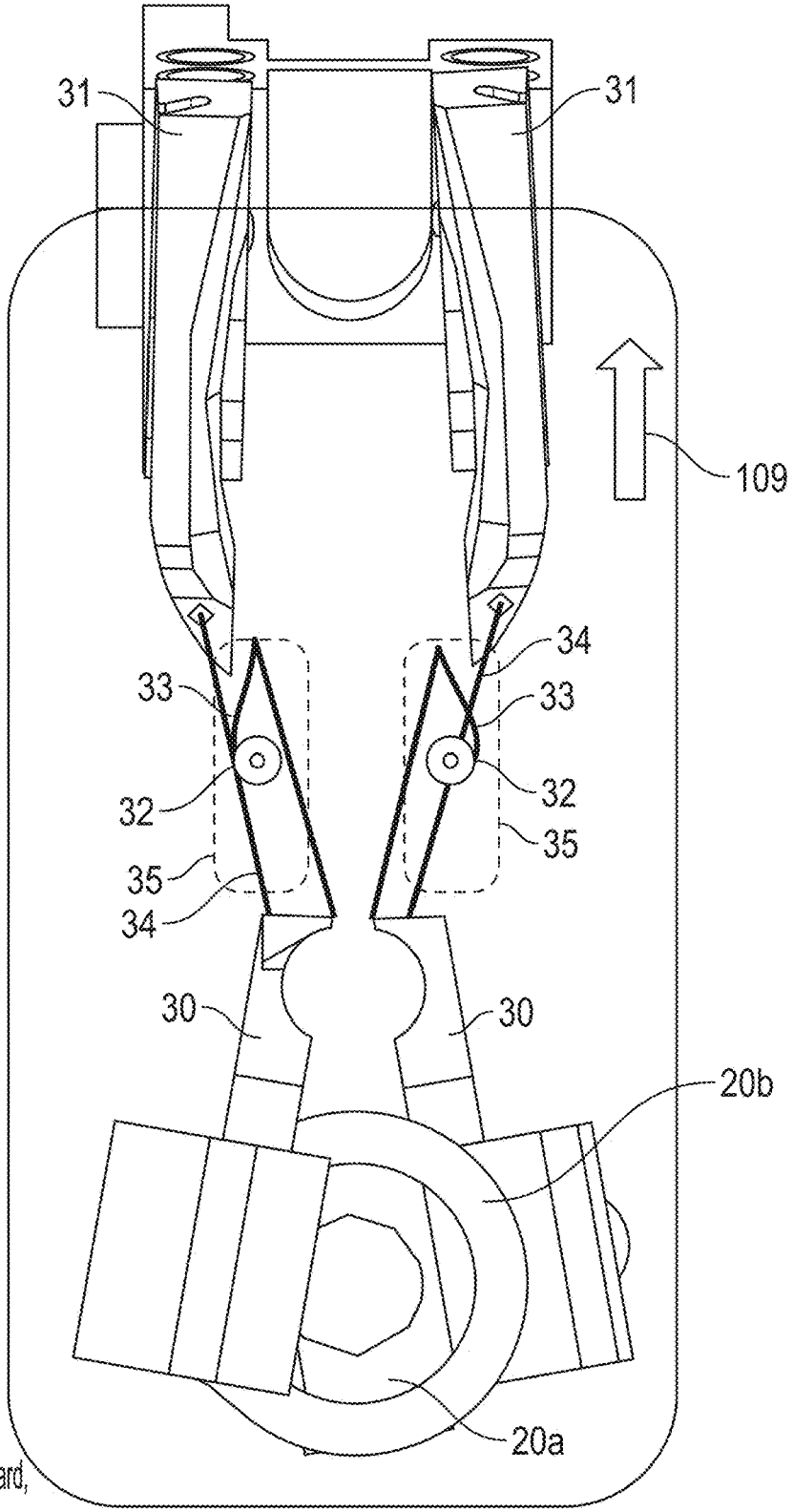

In FIG. 9F, the needles 32 near bottom dead center and the loopers 31 continue their movement rearward, releasing their respective upper thread 33 and the spreaders 30 remain closed with their respective lower thread 34 retained.

Figure 9G:
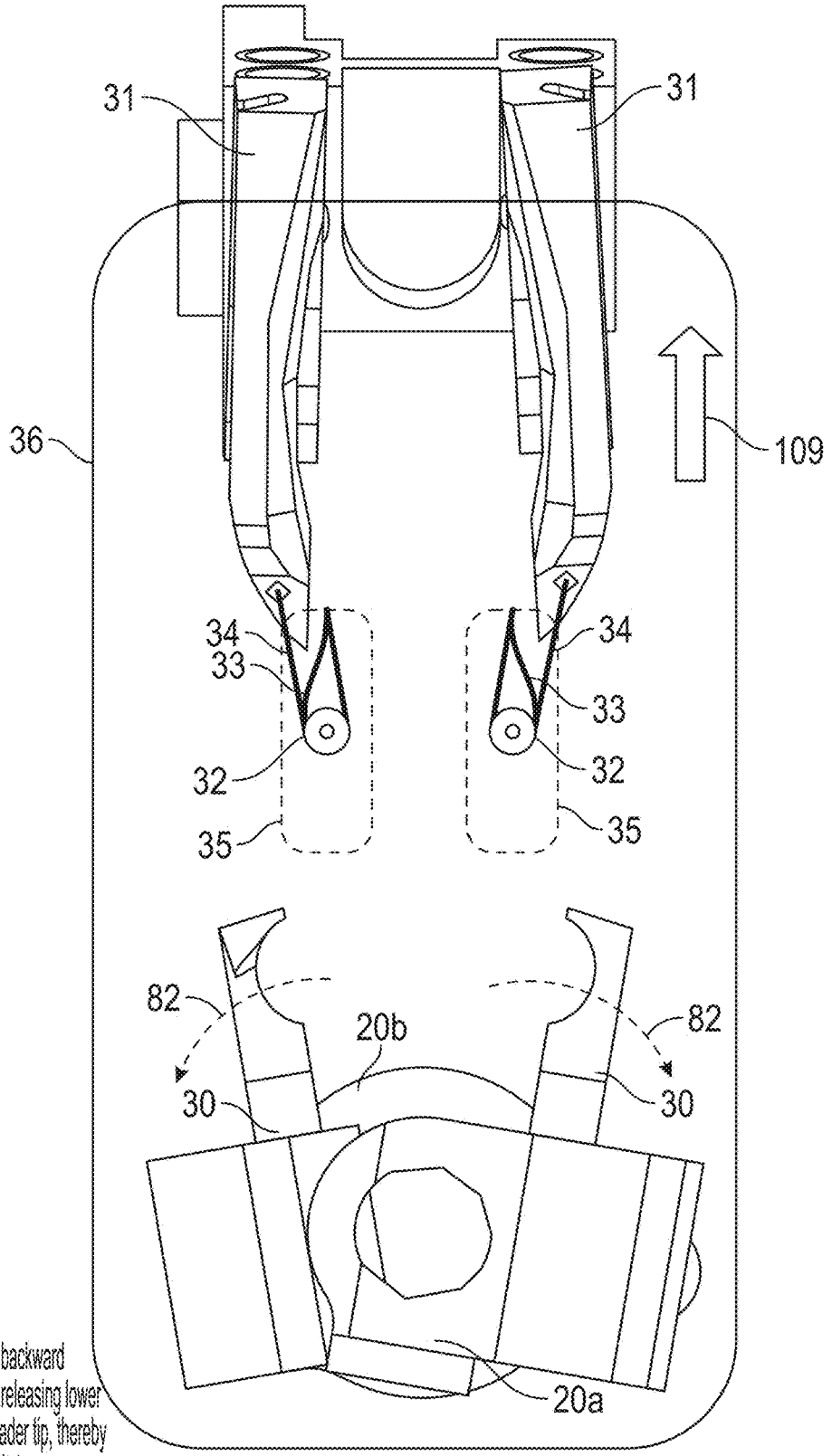

In FIG. 9G, the needles 32 are at bottom dead center and the loopers 31 are moving rearward in the direction of arrow 109. The spreaders 30 are open and releasing their respective lower thread 34 from the spreader tip thereby completing the stitch.

Figure 9H:
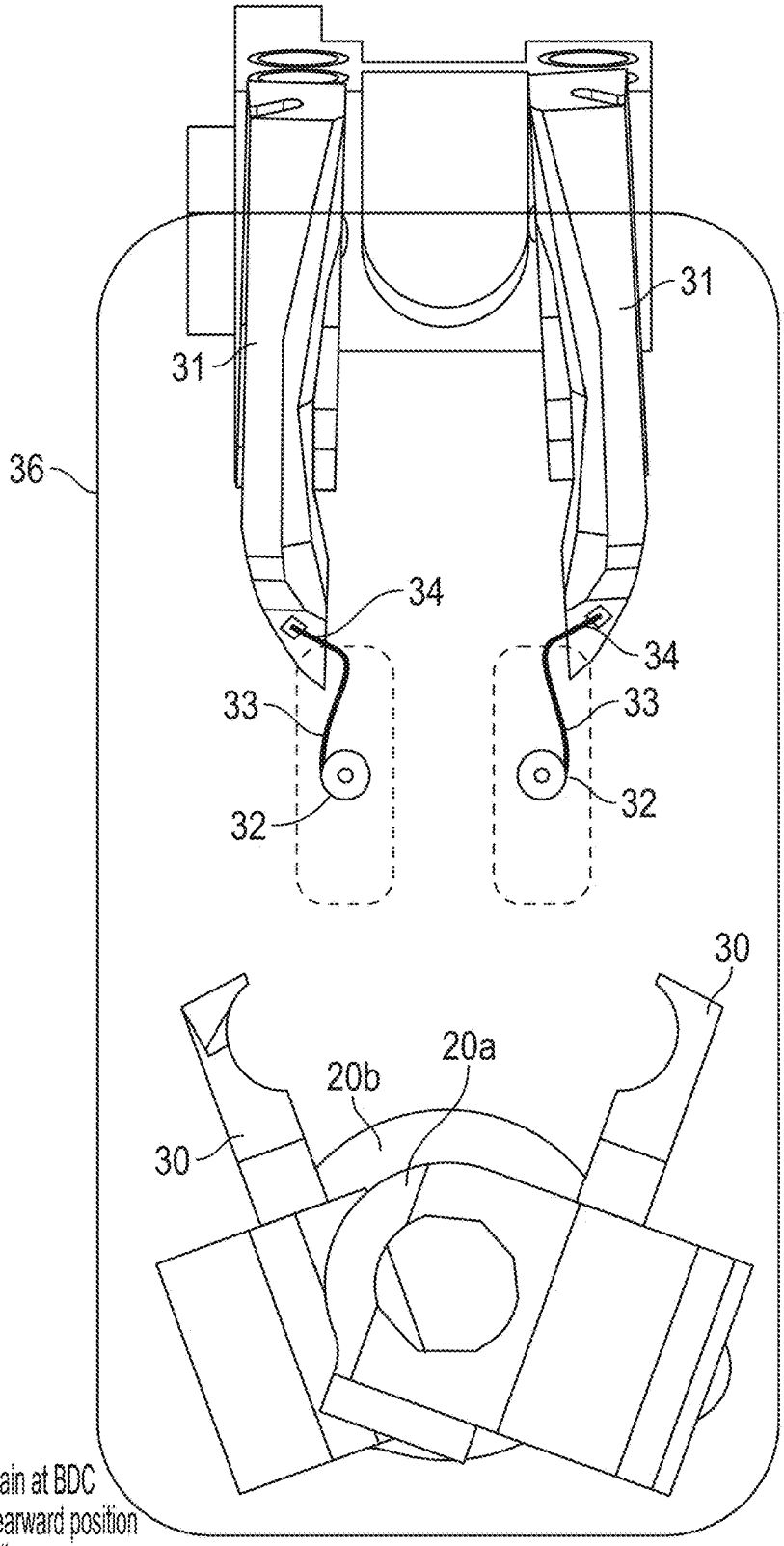

In FIG. 9H the needles 32 remain at bottom dead center and the loopers 31 are at a rearward position and the spreaders 30 are fully open and ready for the start of the next stitch cycle.

Through elimination of parts and simplification of the needle bar rotation and spreader drive system, this robot sewing head design will be compact enough to provide access to stitch all but the most remote areas of a preformed automotive trim component.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An ornamental chain stitching head, comprising:

an upper head assembly, the upper head assembly controls movement of a needle bar and a walking foot mechanism;

a walking foot eccentric configured to allow adjustment of a foot lift while a stitch length eccentric is configured to allow for adjustment of both a walking foot and a needle bar advancement via regulation of a rock frame the determines a length of a stitch created by the ornamental chain stitching head;

a lower head assembly; and a needle bar cam assembly that drives rotation of the needle bar during each stitch cycle of the ornamental chain stitching head to achieve desired stitch patterns, the needle bar cam assembly is driven directly by an upper shaft through a pair of gears that reduce a speed of the needle bar cam assembly according to a size ratio of the pair of gears.

2. The ornamental chain stitching head as in claim 1, wherein two different cam profiles are machined into the needle bar cam assembly.

3. The ornamental chain stitching head as in claim 2, wherein a cam follower engages one of the two different cam profiles which in turn drive a linkage that connects to a drive gear.

4. The ornamental chain stitching head as in claim 3, wherein lateral movement of the linkage is managed by two bearing blocks that engage a guide rail.

5. An ornamental chain stitching head, comprising:

an upper head assembly, the upper head assembly controls movement of a needle bar and a walking foot mechanism, the needle bar having a pair of needles; and a lower head assembly, the lower head assembly including:

a pair of loopers each having a scarf facing each other; and a pair of spreaders, the lower head assembly configured to move pair of loopers towards the pair of spreaders and away from the pair of spreaders during a stitching sequence of the ornamental chain stitching head and the lower head assembly configured to move the pair of spreaders towards and away from each other during the stitching sequence of the ornamental chain stitching head.

6. The ornamental chain stitching head of claim 5, wherein the pair of needles are received within the pair of loopers during the stitching sequence of the ornamental chain stitching head.

7. The ornamental chain stitching head of claim 5, wherein the lower head assembly further comprises a pair of concentric shafts rotatably secured to each other such that one of the pair of concentric shafts rotates about the other one of the pair of concentric shafts rotates and the other one of the pair of concentric shafts rotates within the one of the pair of concentric shafts, one of the pair of concentric shafts being operably secured to the one of the pair of spreaders and the other one of the pair of concentric shafts is secured to the other one of the pair of spreaders such that rotation of the pair of concentric shafts with respect to each other causes the pair of spreaders to move towards and away from each other during the stitching sequence of the ornamental chain stitching head.

8. The ornamental chain stitching head of claim 7, wherein the pair of concentric shafts are rotated by a spreader cam that engages a spreader cam follower which is directly connected to a bearing block, wherein rotation of the spreader cam causes rotation of the pair of concentric shafts with respect to each other.

9. The ornamental chain stitching head of claim 8, wherein the bearing block rides on a guide rail.

10. The ornamental chain stitching head of claim 8, wherein the bearing block further comprises a pin that serves as a hub for rotatably receiving one end of each of a pair of connecting rods and an opposite end of each of the pair of connecting rods is rotatably secured to one of a pair of crank arms, one of the pair of crank arms is secured to one of the pair of concentric shafts and the other one of the pair of crank arms is secured to the other one of the pair of concentric shafts.

11. The ornamental chain stitching head of claim 10, wherein linear movement of the bearing block causes rotational movement of the pair of concentric shafts with respect to each other.

12. A method of providing a stitch to a part with an ornamental chain stitching head, comprising:

moving a pair of needles up and down with an upper head assembly; and engaging an upper thread of each of the pair of needles with a pair of loopers of a lower head assembly during a stitching sequence of the ornamental chain stitching head, the pair of loopers each having a scarf facing each other; and engaging a lower thread of each of the pair of loopers with a pair of spreaders during the stitching sequence of the ornamental chain stitching head, the lower head assembly moving the pair of loopers towards the pair of spreaders and away from the pair of spreaders during the stitching sequence of the ornamental chain stitching head and the lower head assembly moving the pair of spreaders towards and away from each other during the stitching sequence of the ornamental chain stitching head.

13. The method of claim 12, wherein the pair of needles are received within the pair of loopers during the stitching sequence of the ornamental chain stitching head.

14. The method of claim 12, wherein the lower head assembly further comprises a pair of concentric shafts rotatably secured to each other such that one of the pair of concentric shafts rotates about the other one of the pair of concentric shafts rotates and the other one of the pair of concentric shafts rotates within the one of the pair of concentric shafts, one of the pair of concentric shafts being operably secured to the one of the pair of spreaders and the other one of the pair of concentric shafts is secured to the other one of the pair of spreaders such that rotation of the pair of concentric shafts with respect to each other causes the pair of spreaders to move towards and away from each other during the stitching sequence of the ornamental chain stitching head.

15. The method of claim 14, wherein the pair of concentric shafts are rotated by a spreader cam that engages a spreader cam follower which is directly connected to a bearing block, wherein rotation of the spreader cam causes rotation of the pair of concentric shafts with respect to each other.

16. The method of claim 15, wherein the bearing block rides on a guide rail.

17. The method of claim 15, wherein the bearing block further comprises a pin that serves as a hub for rotatably receiving one end of each of a pair of connecting rods and an opposite end of each of the pair of connecting rods is rotatably secured to one of a pair of crank arms, one of the pair of crank arms is secured to one of the pair of concentric shafts and the other one of the pair of crank arms is secured to the other one of the pair of concentric shafts.

18. The method of claim 17, wherein linear movement of the bearing block causes rotational movement of the pair of concentric shafts with respect to each other.

19. The method of claim 12, wherein movement of the pair of loopers and the pair of spreaders is limited to an area defined by a stitch plate having a width of 35 mm or less and a length of 56 mm or less during the stitching sequence of the ornamental chain stitching head.

20. The method of claim 12, wherein the pair of needles are received within the pair of loopers during the stitching sequence of the ornamental chain stitching head and the lower head assembly further comprises a pair of concentric shafts rotatably secured to each other such that one of the pair of concentric shafts rotates about the other one of the pair of concentric shafts rotates and the other one of the pair of concentric shafts rotates within the one of the pair of concentric shafts, one of the pair of concentric shafts being operably secured to the one of the pair of spreaders and the other one of the pair of concentric shafts is secured to the other one of the pair of spreaders such that rotation of the pair of concentric shafts with respect to each other causes the pair of spreaders to move towards and away from each other during the stitching sequence of the ornamental chain stitching head.

* * * * *